US008408681B2

(12) United States Patent
Sakai et al.

(10) Patent No.: US 8,408,681 B2
(45) Date of Patent: Apr. 2, 2013

(54) LIQUID DISCHARGE HEAD HAVING AN INCREASED RIGIDITY

(75) Inventors: Toshiyasu Sakai, Kawasaki (JP); Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 13/107,328

(22) Filed: May 13, 2011

(65) Prior Publication Data

US 2012/0120158 A1 May 17, 2012

(30) Foreign Application Priority Data

May 19, 2010 (JP) ..... 2010-115232
May 19, 2010 (JP) ..... 2010-115233
Apr. 27, 2011 (JP) ..... 2011-099580

(51) Int. Cl.
*B41J 2/05* (2006.01)

(52) U.S. Cl. ..... 347/65; 347/63; 347/56; 347/47

(58) Field of Classification Search ..... 347/20, 347/44, 47, 56, 61–65, 67
See application file for complete search history.

(56) References Cited

U.S. PATENT DOCUMENTS 6,796,019 B2 * 9/2004 Komplin et al. ..... 347/65

FOREIGN PATENT DOCUMENTS

JP 10-157050 A 6/1998
JP 2005-125516 A 5/2005

* cited by examiner

*Primary Examiner* — Juanita D Jackson
(74) *Attorney, Agent, or Firm* — Canon USA Inc IP Division

(57) ABSTRACT

A liquid discharge head includes a plurality of nozzle arrays. A concave portion is formed on a back side of a head substrate, and all supply ports are formed in the bottom of the concave portion. The head substrate and a supporting member are bonded at the bottom of the concave portion so that the supply port and an introduction port communicate with each other. According to such a configuration, a ground contact area can be sufficiently secured, so that a liquid discharge head that is highly reliable and having high heat dissipation ability, and that can be manufactured with high productivity can be achieved.

9 Claims, 14 Drawing Sheets

LIQUID DISCHARGE HEAD HAVING AN INCREASED RIGIDITY

BACKGROUND OF THE INVENTION

1. Field of the Invention

The present invention relates to a liquid discharge head, and more specifically to an inkjet recording head.

2. Description of the Related Art

Japanese Patent Application Laid-Open No. 2005-125516 discusses an inkjet recording head. The inkjet recording head is configured by bonding an inkjet substrate, on which an electrothermal conversion element is formed, with a supporting member, to connect to an external ink supplying system and to hold the substrate.

In a case where the inkjet recording head is capable of printing in a plurality of colors with one inkjet substrate, it becomes necessary to seal the inks from each other at a bonding section between the inkjet substrate and the supporting member to prevent mixing of the different inks. Further, it becomes necessary to maintain an adequate area of the bonding section to increase reliability of sealing.

Further, in recent years, there is a demand for an inkjet recording method which outputs higher resolution images at higher speed. There is thus a demand to increase the number of nozzles that discharge the inks and to increase discharge frequency.

On the other hand, if the recording speed increases, energy input to the head per unit time and temperature rise of the head during recording increase. If the temperature of the head rises, an ink discharge amount for each page becomes different, so that ink discharge becomes unstable at high temperature. Further, continuous recording performance may be lowered.

Japanese Patent Application Laid-Open No. 2005-125516 discusses an inkjet recording head in which the inkjet substrate is fixed to the supporting member, so that the heat generated in the inkjet substrate is diffused to the supporting member. The temperature rise in the inkjet recording head can thus be reduced by increasing the area of the bonding section between the inkjet substrate and the supporting member (hereinafter referred to as a ground contact area).

However, if the ground contact area between the inkjet substrate and the supporting member is increased to reduce the temperature rise in the inkjet recording head, the size of the inkjet substrate becomes large, so that productivity is reduced.

To solve such a problem, the entire inkjet substrate may be thinned. In other words, the size of an opening of an ink supply port can be decreased by thinning the entire inkjet substrate. The ground contact area between the inkjet substrate and the supporting member can thus be secured without increasing the size of the inkjet substrate.

However, if such a method is selected, the strength of the inkjet substrate is decreased, so that warpage is generated in the inkjet substrate due to a stress of a flow path forming member. In such a case, the productivity is greatly reduced.

SUMMARY OF THE INVENTION

The present invention is directed to a liquid discharge head in which the ground contact area between the supporting member and the head substrate can be secured, and which can be manufactured with high productivity. More specifically, the present invention is directed to a liquid discharge head which is highly reliable and having high heat dissipation ability due to a sufficient ground contact area, and which can be manufactured with high productivity.

According to an aspect of the present invention, a liquid discharge head includes a flow path forming member that configures a discharge port for discharging a liquid and a liquid flow path that communicates with the discharge port, and includes a plurality of nozzle arrays formed of the discharge port and the liquid flow path that spatially communicate with each other, a head substrate including a discharge energy generation element that generates energy for discharging the liquid, and in which a supply port for supplying the liquid to the liquid flow path is formed for each of the nozzle array, and a supporting member including an introduction port for supplying the liquid to the supply port, wherein the head substrate includes a concave portion on an opposite side of a surface on which the flow path forming member is disposed, wherein all of the supply ports are formed through the head substrate in the bottom of the concave portion, and wherein the head substrate and the supporting member are bonded at the bottom of the concave portion so that the supply port and the introduction port communicate with each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Exemplary embodiments of the liquid discharge head will be described below. The inkjet recording head may be described as an application example of the present invention. However, the scope of the application is not limited thereto.

For example, the present invention can be applied in creating a biochip or printing an electric circuit, in addition to performing ink recording. The present invention is related to a liquid discharge head that discharges a liquid, and a color filter manufacturing head is an example of the liquid discharge head other than the inkjet recording head.

Figure 1:
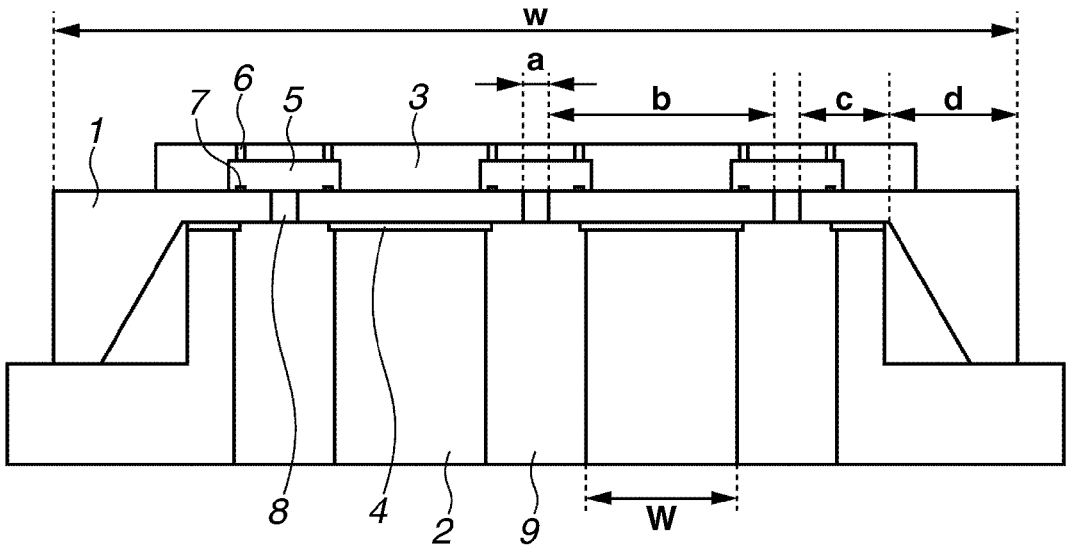
FIG. 1 is a schematic cross-sectional view illustrating an inkjet recording head according to an exemplary embodiment of the present invention.
Figure 2:
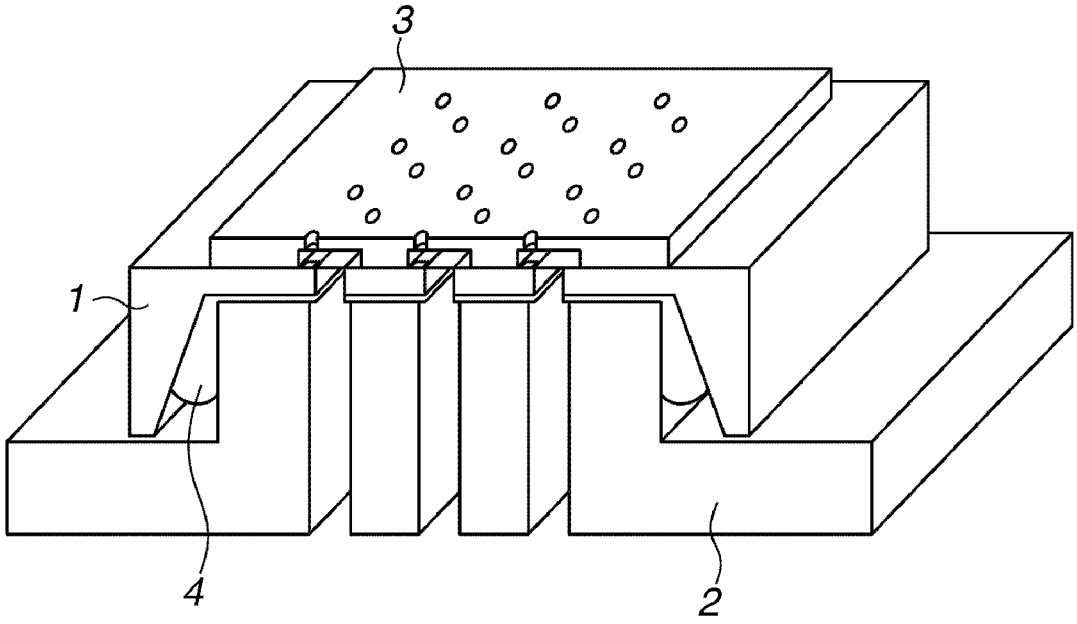
FIG. 2 is a schematic cross-sectional perspective view illustrating the inkjet recording head according to an exemplary embodiment of the present invention.
Figure 3A:
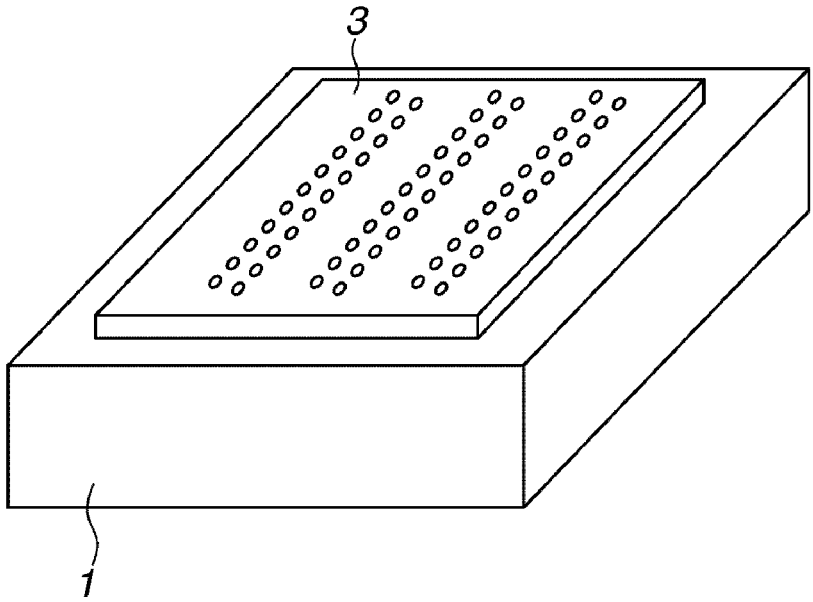
FIGS. 3A and 3B are schematic diagrams illustrating bonding between the inkjet head substrate and a supporting member according to an exemplary embodiment of the present invention.
Figure 3B:
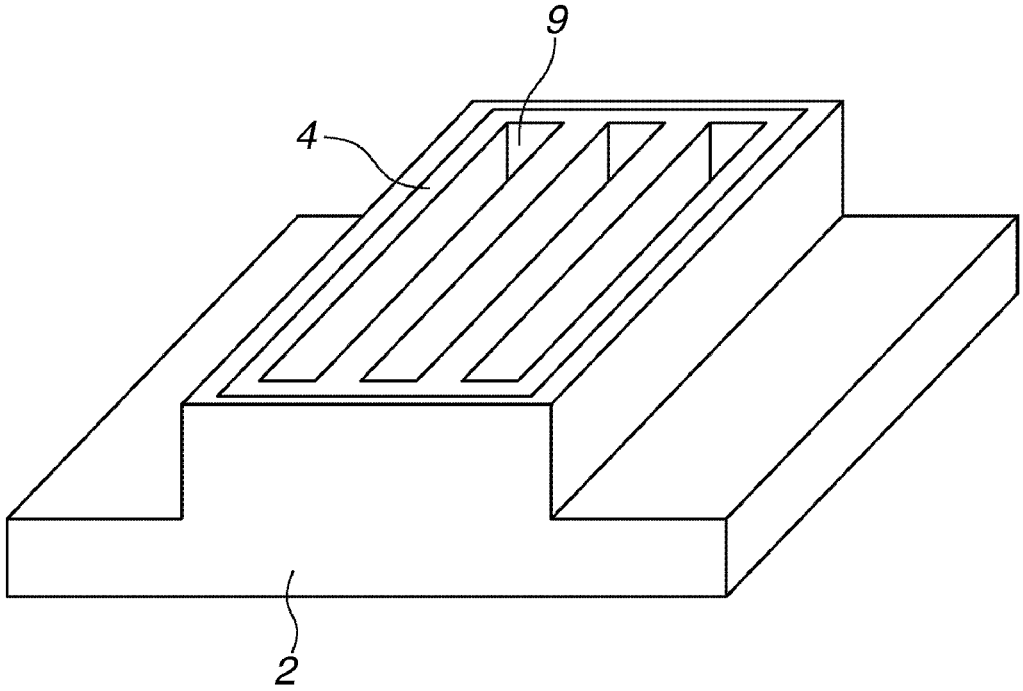

FIG. 1 is a cross-sectional view illustrating an inkjet recording head according to a first exemplary embodiment. FIG. 2 is a schematic cross-sectional perspective view illustrating the inkjet recording head according to the present exemplary embodiment. FIG. 3A is a schematic perspective view illustrating a discharge element substrate configured of an inkjet substrate and a flow path forming member according to the present exemplary embodiment. FIG. 3B is a schematic perspective view illustrating a supporting member.

Referring to FIGS. 1, 2, 3A, and 3B, the inkjet recording head is configured by an inkjet substrate 1 on which a flow path forming member 3 is formed on an upper surface, bonded to a supporting member 2 by an adhesive 4. The inkjet substrate 1 includes a concave portion on an opposite side of the surface on which the flow path forming member 3 is disposed. The inkjet substrate 1 is bonded to the supporting member 2 at the bottom of the concave portion.

The flow path forming member 3 configures an ink flow path 5 and an ink discharge port 6, and is formed on the inkjet substrate 1.

The inkjet substrate 1 includes a plurality of discharge energy generation elements 7, such as electrothermal conversion elements, for discharging the ink. Further, the inkjet substrate 1 may include wiring (not illustrated) for driving the discharge energy generation elements. Furthermore, the inkjet substrate 1 includes an ink supply port 8 for supplying the ink to the ink flow path 5. A plurality of ink supply ports 8 is formed through the inkjet substrate in the bottom of the concave portion.

The supporting member 2 includes an ink introduction port 9 for supplying the ink to the ink supply port 8. The supporting member 2 is bonded to the inkjet substrate 1 at the bottom of the concave portion so that the ink introduction port 9 and the ink supply port 8 can communicate with each other. The inkjet recording head may include an ink supplying member (not illustrated) that stores the ink to be supplied to the ink introduction port 9 in the supporting member 2.

A plurality of nozzle arrays including the ink discharge port, the ink flow path, and the ink supply port that spatially communicate with each other are formed in the flow path forming member 3. In other words, a plurality of ink flow paths 5 and a plurality of discharge ports 6 are disposed to form the plurality of nozzle arrays (refer to FIG. 3A).

Further, the ink supply port 8 which runs through the inkjet substrate is formed for each nozzle array. As illustrated in FIG. 3A, it is preferable for the nozzle arrays to be disposed in rows. One nozzle array can hold and discharge the same ink.

Furthermore, in the present exemplary embodiment, one ink supply port 8 is formed for one nozzle array. A plurality of openings of the ink discharge ports 8 is arranged in a rectangular shape along the nozzle array in the bottom of the concave portion. Moreover, the supporting member 2 includes a convex portion to fit inside the concave portion, and a plurality of ink introduction ports 9 that opens on the upper surface of the convex portion is formed in the supporting member 2.

Each of the ink introduction ports 9 is disposed to communicate with each of the ink supply ports 8. A plurality of the ink introduction ports 9 is formed in rows as illustrated in FIG. 3B.

According to the present invention, a liquid discharge head which is highly reliable and having high heat dissipation ability without reducing the productivity of the inkjet substrate can be provided. The liquid discharge head according to the present invention can be thus adapted into high-speed printing.

The effects of the present invention will be described in detail below. If the ground contact area between the inkjet head and the supporting member is enlarged to improve the reliability or the heat dissipation, intervals between the nozzle arrays increase. As a result, the substrate area increases, so that productivity may be reduced.

On the other hand, if the opening area of the ink supply port can be reduced, the interval between the nozzle arrays can also be reduced, so that the productivity can be increased. The ink supply port may be formed by anisotropic etching to reduce the opening area of the ink supply port. However, it is not practical in terms of time to employ anisotropic etching for forming a small through hole on a general wafer to be used in the inkjet substrate.

Further, if the entire inkjet substrate is thinned and the ink supply port is formed by anisotropic etching, the opening of the ink supply port can be formed small. However, if the inkjet substrate is thinned, the strength of the inkjet substrate is reduced. Warpage is thus generated in the inkjet substrate due to stress in the flow path forming member, so that productivity may be greatly reduced.

To solve such a problem, according to the present invention, the concave portion is formed on the inkjet substrate, and the inkjet supply port is formed in the bottom of the concave portion at which the substrate is thin. As a result, the strength of the inkjet substrate is maintained while the opening of the inkjet supply port can be formed small, and a large ground contact area between the supporting member and the inkjet substrate can be acquired. An inkjet recording head which is highly reliable and having high heat dissipation ability can thus be achieved with high productivity.

Further, according to another aspect of the present invention, an inkjet recording head having durability and that can be downsized can be acquired. In other words, according to the present invention, since the strength of the inkjet substrate is maintained while the opening of the inkjet supply port is formed small, the inkjet recording head can be downsized while maintaining the durability.

Furthermore, the nozzle array intervals can be reduced, and the discharge port can be formed with high density, so that discharge performance can be improved.

The inkjet recording head is described above as an exemplary embodiment of the present invention. However, the present invention is not limited thereto, and the present invention is related to a liquid discharge head that discharges liquid such as ink.

If the inkjet recording head is defined as a liquid discharge head, basic configurations thereof are similar. The terms used for each head can be defined as follows: the ink corresponds to the liquid, the inkjet substrate corresponds to the head substrate, the ink discharge port corresponds to the discharge port, the ink flow path corresponds to the liquid flow path, the ink supply port corresponds to the supply port, the ink introduction port corresponds to the introduction port, and the ink supplying member corresponds to the liquid supplying member.

As described above, in the head substrate, the concave portion is formed on the opposite side (i.e., the back side) of the surface on which the flow path forming member is disposed. There is no limitation on a method for forming the concave portion. For example, the concave portion can be formed using crystal anisotropic etching.

The head substrate may be formed using a silicon substrate. In such a case, it is preferable to form the concave portion employing crystal anisotropic etching of the silicon substrate, by which the concave portion can be efficiently formed on the head substrate with high productivity.

Further, the head substrate is formed by the silicon substrate having a crystal orientation of a <100> plane. In such a case, the bottom of the concave portion becomes the <100> plane formed by crystal anisotropic etching of the silicon substrate, and the <100> plane becomes the bonding surface between the head substrate and the supporting member.

More specifically, a portion of the silicon substrate is removed by the crystal anisotropic etching, and the <100> plane that is exposed as a result becomes the bonding surface between the supporting member and the head substrate. The thickness of the silicon substrate may be 0.3 mm to 1.0 mm. A depth of the concave portion may be 325 to 675 μm.

According to the present invention, the flow path forming member includes a plurality of nozzle arrays that each include the discharge port and the liquid flow path that spatially communicate with each other. There is at least one supply port formed for each nozzle array, and all supply ports are formed in the bottom of the concave portion.

Referring to FIGS. 1, 2, and 3A, one supply port having a rectangular opening is formed along one nozzle array. However, the present invention is not limited thereto, and a plurality of supply ports may be formed for one nozzle array.

If a plurality of supply ports is formed for one nozzle array, the supporting member may, for example, form the introduction port for each of the supply ports that communicate with the same nozzle array. Further, one introduction port may be formed for the plurality of supply ports that communicate with a nozzle array.

The supply port can be formed employing anisotropic etching, such as dry etching including reactive ion etching (RIE), and crystal anisotropic etching. It is preferable to form the supply port using Bosch process employing RIE. The height of the supply port may be set to 50 to 400 μm.

There is no particular limit on a material of the supporting member. For example, it is preferable to use alumina ($Al_2O_3$) and silicon (Si) having high heat conductivity, aluminum nitride (AlN), zirconia ($ZrO_2$), silicon nitride ($Si_3N_4$), silicon carbide (SiC), molybdenum (Mo), and tungsten (W).

Further, alumina which is of high heat conductivity and ink durability is preferably used, and in particular, alumina ceramics is preferably used. Furthermore, resin materials can be used, and the supporting member can be formed by resin molding of Noryl resin. Moreover, modified polyphenylene ether (PPE) which is a polymer alloy of PPE and polystyrene (PS) may be used as the resin material.

If the heat generated in the discharge energy generation element, such as the electrothermal conversion element, is to be diffused from the head substrate to the supporting member, it is desirable to use the supporting member formed of alumina. The material of a supporting member 10 is not limited to alumina. The supporting member 10 may be formed by a material whose linear expansion coefficient is of the same level as that of the head substrate and having heat conductivity of the same level as that of the head substrate.

As described above, the supporting member is bonded to the head substrate at a region in which the portion of the head substrate is thinned, i.e., the bottom of the concave portion. For example, the head substrate and the supporting member may be bonded using the adhesive. Since there is a thick region in the edge portion of the head substrate, the strength can be maintained.

The supporting member may be shaped to include, for example, a convex portion, so that the supporting member can be bonded to the bottom of the concave portion on the head substrate. Further, it is preferable for the supporting member to include a convex-shaped portion that matches with the concave portion of the head substrate.

Examples of materials that can be used to form the flow path forming member are photosensitive epoxy resin and photosensitive acryl resin. It is preferable to use a photoreactive cationic polymerizable compound. Since the durability is greatly determined by the type and the characteristic of the liquid to be used, an appropriate compound can be selected as the material of the flow path forming member depending on the liquid such as ink.

The head substrate can include a wiring layer for transmitting an electrical signal. For example, an A1 wiring can be formed using a film forming technology.

As described above, the liquid discharge head may include the liquid supplying member for supplying the liquid to the introduction port of the supporting member. The liquid supplying member is a tank for supplying the liquid, such as the ink, to the introduction port of the supporting member, and may be formed by either an organic or inorganic material.

It is desirable for the liquid supplying member to be formed by a material that does not expand or dissolve even when the liquid supplying member comes into contact with the liquid, such as the ink, to be stored inside, or that does not cause elution of the organic or inorganic material.

Further, a thermoplastic resin is preferably used as the material for forming the liquid supplying member in terms of actual cost of the material and ease of processing. For example, a general-purpose resin such as polypropylene and modified PPE is mainly used as the ink supplying member. Silica and alumina can be used as a strengthening agent to increase mechanical strength.

Furthermore, the supporting member and the liquid supplying member may be integrally formed by insert molding.

Moreover, the inkjet recording head according to the present exemplary embodiment may be installed in apparatuses such as a printer, a copying machine, a facsimile machine including a communication system, and a word processor including a printer unit. Further, the inkjet recording head according to the present exemplary embodiment may be installed in industrial recording apparatuses in which various processing apparatuses are multiply combined. The inkjet recording head can be used to record on various recording media such as paper, thread, textile, silk, leather, metal, plastic, glass, wood, and ceramics.

A liquid discharge head which can more efficiently control the temperature will be described below.

Figure 6:
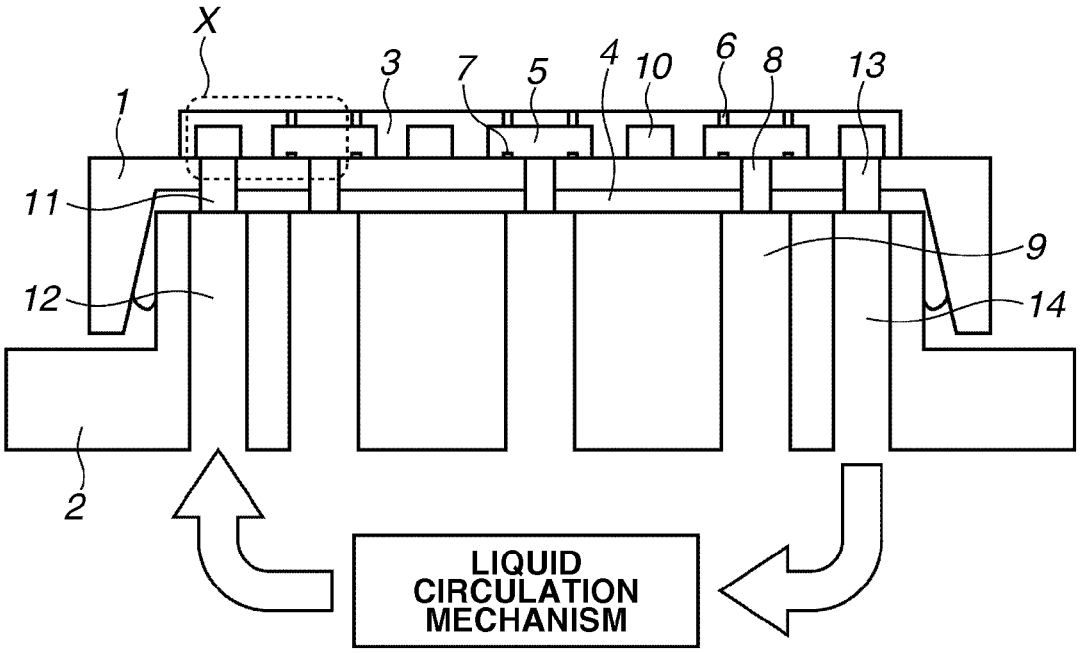
FIG. 6 is a schematic cross-sectional view illustrating the inkjet recording head according to an exemplary embodiment of the present invention.
Figure 7:
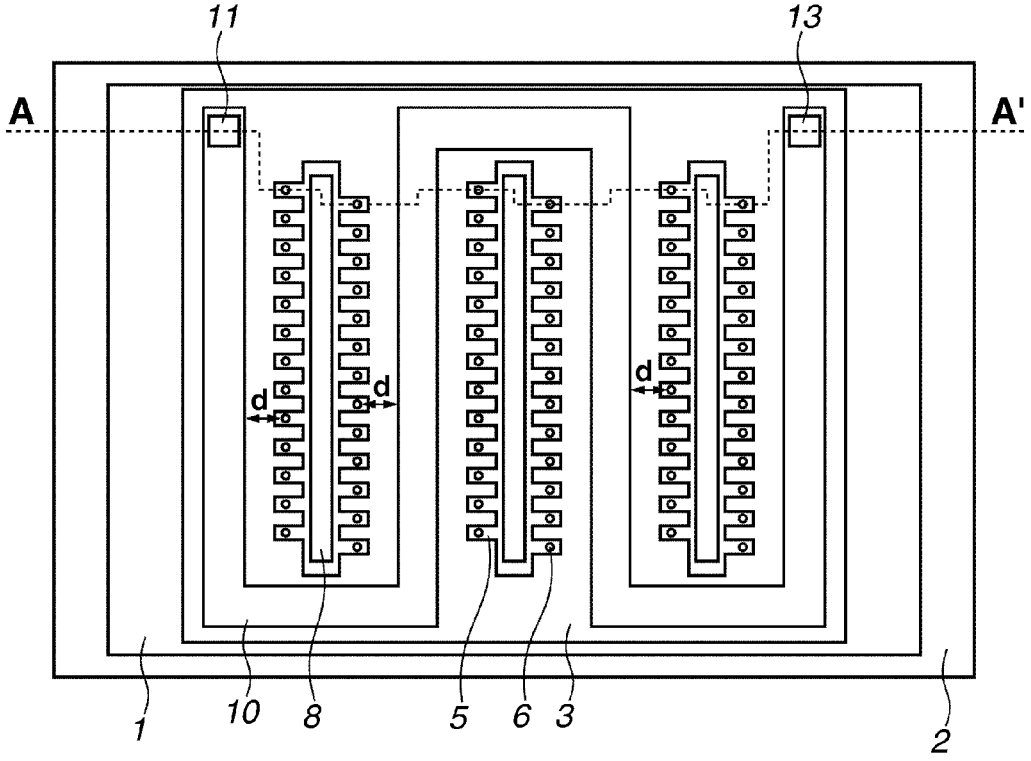
FIG. 7 is a schematic plan view illustrating a layout example of each of elements in the inkjet recording head according to an exemplary embodiment of the present invention.

FIG. 6 is a schematic cross-sectional view illustrating an inkjet recording head according to a second exemplary embodiment. FIG. 7 is a schematic plan view illustrating positions in which each of the elements is disposed, viewed from the front side (i.e., the flow path forming member side) of the inkjet recording head according to the present exemplary embodiment.

Figure 8:
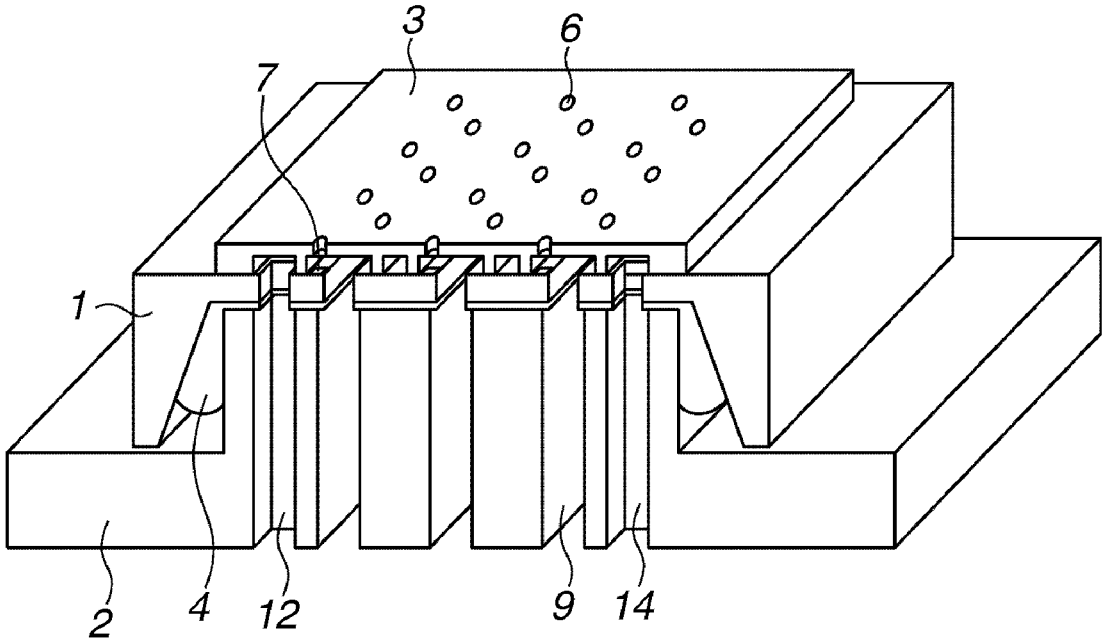
FIG. 8 is a schematic perspective view illustrating the inkjet recording head cut in a vertical direction according to an exemplary embodiment of the present invention.

FIG. 8 is a schematic perspective view illustrating the inkjet recording head in which one portion is cut. FIG. 6 is the cross-sectional view corresponding to a cross section taken along a dotted line A-A' illustrated in FIG. 7.

Referring to FIG. 6, the inkjet recording head includes a discharge element substrate configured of a flow path forming member 3 and an inkjet substrate (head substrate) 1. Further, the inkjet recording head includes a supporting member 2 that is bonded, using an adhesive 4, with the discharge element substrate, on the side of the inkjet substrate 1 opposite to the side in which the flow path forming member 3 is disposed.

The flow path forming member 3 is formed on the inkjet substrate 1. Further, the flow path forming member 3 includes an ink flow path (i.e., a first liquid flow path) in which the ink (i.e., a first liquid) flows, an ink discharge port (i.e., discharge port) 6, and a temperature control flow path (i.e., a second liquid flow path) 10 in which a temperature control liquid (i.e., a second liquid) flows.

A temperature control medium flowing in the temperature control flow path 10 is not particularly limited, and may be water or oil. The temperature control medium is mainly used to cool the inkjet recording head. The first liquid flow path and the second liquid flow path are independent of each other. Further, the second liquid is not used in discharging. Since the recording head is configured similarly to that in the first exemplary embodiment, the second liquid flow path can be easily formed.

The inkjet substrate 1 includes a plurality of discharge energy generation elements 7, such as the electrothermal conversion elements, for discharging the ink. The inkjet substrate 1 may also include wiring (not illustrated) for driving the discharge energy generation elements 7. Further, the inkjet substrate 1 includes an ink supply port (i.e., supply port) 8 for supplying the ink to the ink flow path 5.

Furthermore, the inkjet substrate 1 includes a supply passage (i.e., a first liquid passage) 11 that is a through-port for supplying the temperature control liquid to the temperature control flow path 10. Moreover, the inkjet substrate 1 includes a discharge passage (i.e., a second liquid passage) 13 that is a through-port for discharging the temperature control liquid from the temperature control flow path 10.

A plurality of nozzle arrays formed of the ink discharge port 6 and the ink flow path 5 that spatially communicate with each other are formed in the flow path forming member 3 as illustrated in FIGS. 6 and 7. In other words, the plurality of the ink discharge ports 6 and the plurality of ink flow paths 5 are disposed to form the plurality of nozzle arrays.

Further, the ink supply port 8 that runs through the inkjet substrate 1 is formed for each nozzle array. One nozzle array can contain and discharge the same ink.

Referring to FIG. 7, the temperature control flow path 10 is formed of one flow path to be disposed along both sides of each nozzle array. The temperature control flow path 10 includes a liquid inlet to which the temperature control liquid is supplied, and a liquid outlet from which the temperature control liquid is discharged. The liquid inlet is connected to the supply passage 11 and the liquid outlet is connected to the discharge passage 13.

Further, the temperature control flow path 10 is extended along the nozzle array from the liquid inlet disposed near a corner region of the flow path forming member 3. The temperature control flow path 10 then passes between each of the nozzle arrays and reaches the liquid outlet disposed near the corner region of the flow path forming member 3. The temperature control liquid is thus supplied from the supply passage 11 to the temperature control flow path 10, flows through the temperature control flow path 10, and is discharged from the discharge passage 13.

The temperature of the inkjet recording head, or more preferably the temperature of the discharge element substrate, can be controlled by the temperature control liquid flowing into the temperature control flow path 10. For example, if cooled temperature control liquid is caused to flow in the temperature control flow path 10, the temperature control liquid absorbs the heat generated from the discharge energy generation element. The discharge element substrate of the inkjet recording head can then be effectively cooled.

It is not particularly necessary to use the cooled temperature control liquid. The heat generated by the discharge energy generation element can be released to outside of the discharge element substrate by causing the temperature control liquid of room temperature to flow in the temperature control flow path 10.

Further, the inkjet recording head is connected to a liquid circulation mechanism, such as a pump, so that the temperature control liquid discharged from the discharge passage 13 is re-supplied to the supply passage 11. The liquid circulation mechanism can be included in the liquid discharge apparatus such as the inkjet printer. The temperature control liquid can release and absorb the heat while being circulated by the liquid circulation mechanism.

Furthermore, the liquid discharge apparatus can include a temperature control mechanism that adjusts the temperature of the liquid. More specifically, the temperature control mechanism effectively adjusts the temperature of the temperature control liquid discharged from the discharge passage 13 and returns the temperature control liquid to the supply passage 11. In particular, according to the present invention, it is preferable for the temperature control mechanism to include a cooling function that cools the liquid to effectively cool the heat that is generated in the discharge energy generation element.

The liquid circulation mechanism can be configured by a pipe through which the liquid flows, and a pump that generates the energy for moving the liquid.

The inkjet recording head is described above as an exemplary embodiment of the present invention. However, the present invention is not limited thereto, and the present invention is related to a liquid discharge head that discharge liquid such as ink.

If the inkjet recording head is a liquid discharge head, the basic configurations are similar. The terms can be understood as follows, as indicated in above-described brackets: the ink corresponds to the first liquid, the temperature control liquid corresponds to the second liquid, the inkjet substrate corresponds to the head substrate, the ink discharge port corresponds to the discharge port, the ink supply port corresponds to the supply port, the supply passage corresponds to the first liquid passage, and the discharge passage corresponds to the second liquid passage.

The above-described liquid discharge head at least includes the flow path form member and the head substrate, and includes the liquid circulation mechanism. The flow path forming member configures the first flow path in which the first liquid such as the ink flows, and the second liquid flow path in which the second liquid used for performing temperature control flows.

The head substrate includes the supply port for supplying the first liquid to the first liquid flow path, the first liquid passage for supplying the second liquid to the second liquid flow path, and the second liquid passage for discharging the second liquid from the second liquid flow path.

According to the above-described exemplary embodiment of the present invention, the second liquid can be caused to flow in the second liquid flow path formed in the flow path forming member. The temperature of the inkjet recording head, in particular the discharge element substrate, can thus be controlled.

Further, the inkjet recording head whose temperature has risen due to the heat generated in the discharge energy generation element can be effectively cooled by cooling and circulating the second liquid using the temperature control mechanism.

The present invention is not limited to cooling. For example, the temperature control mechanism can be used to heat and circulate the second liquid to adjust the inkjet recording head to an appropriate temperature.

The configuration of the flow path forming member is not particularly limited. However, it is preferable for the flow path forming member to include the plurality of nozzle arrays formed of the discharge port and the first liquid flow path that spatially communicate with each other. Further, at least one supply port is formed for each nozzle array. FIGS. 6, 7, and 8 illustrate examples in which one supply port is formed, having a rectangular opening along one nozzle array. However, a plurality of supply ports may be formed for one nozzle array.

Furthermore, the flow path forming member configures the second liquid flow path for performing temperature control, in addition to the first liquid flow path. The configuration of the second liquid flow path is not particularly limited. However, it is preferable for the second liquid flow path to be disposed along the nozzle array, i.e., in a longitudinal direction of the nozzle array. Moreover, it is preferable for the second liquid flow path to be disposed along both sides of all nozzle arrays.

There is no limitation on the number of the second liquid flow paths, and there may be one, or more than two second liquid flow paths. For example, referring to FIG. 7, one second liquid flow path is formed, including the liquid inlet to which the second liquid is supplied and the liquid outlet from which the second liquid is discharged.

It is also preferable for the second liquid flow path to be disposed along both side of the entire nozzle arrays even when there is only one second liquid flow path. Further, it is desirable for a shortest distance in the horizontal plane between each discharge energy generation element and the second liquid flow path (refer to d in FIG. 7) to be approximately the same.

The first liquid passage and the second liquid passage in the head substrate may be formed in each of the second liquid flow path. Further, a plurality of first liquid passages and a plurality of second liquid passages may be formed in one second liquid flow path. There is no particular limitation. Furthermore, it is preferable that one first liquid passage and one second liquid passage are formed for one second flow path in terms of efficiency of the liquid circulation.

As described above, the head substrate in the liquid discharge head according to the present exemplary embodiment includes the concave portion on the opposite side of the surface on which the flow path forming member is disposed. All of the supply ports are formed through the head substrate in the bottom of the concave portion. The head substrate and the supporting member are bonded at the bottom of the concave portion so that the supply port and the introduction port communicate with each other.

The supporting member includes the introduction port for supplying the first liquid to the supply port. Further, the supporting member includes a first liquid path for supplying the second liquid to the first liquid passage in the head substrate, and a second liquid path for discharging the second liquid from the second liquid passage.

The liquid circulation mechanism transmits the second liquid from the second liquid path to the first liquid path. The introduction port of the supporting member may include a liquid supplying member for supplying the liquid. The liquid supplying member may include a function for containing the second liquid.

There is no particular limitation on the method for forming the supplying passage and the discharging passage formed on the inkjet substrate. It is preferable in terms of design that the supplying passage and the discharging passage are perpendicularly formed using dry etching such as RIE. However, it is not practical in terms of time and cost to form a small through-hole on a general wafer by employing dry etching.

On the other hand, if the entire inkjet substrate is thinned, the through-hole can be efficiently formed using dry etching. However, if the entire inkjet substrate is thinned, the strength is decreased, so that warpage is generated in the inkjet substrate by the stress of the flow path forming member, and productivity may be greatly reduced.

To solve such a problem, as illustrated in FIG. 6, the concave portion is formed on the side of the inkjet substrate that is opposite to the side on which the flow path forming member is disposed. The supporting member and the inkjet substrate are bonded at the bottom of the concave portion.

As a result, the inkjet supply port, the supply passage, and the discharge passage can be efficiently formed in the concave portion using dry etching while maintaining the strength of the inkjet substrate. More specifically, since the edge of the inkjet substrate has a predetermined thickness, the strength can be maintained. Further, since the ink supply port and the supply passage are formed in the bottom of the concave portion at which the substrate is thin, the size of the opening can be formed small.

Furthermore, according to the present exemplary embodiment, the opening of the ink supply port can be formed small while maintaining the substrate strength, so that it is effective in forming high-density nozzles and downsizing the inkjet recording head. Conventionally, the ink supply port is generally formed by crystal anisotropic etching of the silicon substrate. However, since etching is performed with a predetermined inclination in crystal anisotropic etching, the opening of the ink supply port becomes large.

Moreover, as described above, it is not practical in terms of time and cost to perpendicularly form the ink supply port by employing dry etching. Further, if the opening of the ink supply port is decreased by thinning the entire inkjet substrate, the strength is reduced as described above, and the warpage of the inkjet substrate becomes easily generated. To solve such a problem, according to the present exemplary embodiment, all of the ink supply ports are disposed in the bottom of the concave portion, so that the opening size of the ink supply port can be reduced. As a result, the nozzles can be formed with high-density and the inkjet recording head can be downsized.

Furthermore, since the entire inkjet substrate is not thinned, and the periphery of the substrate has a predetermined thickness, the strength can be maintained, and warpage is not generated. In particular, according to the present invention, the temperature control flow path is formed on the flow path forming member separately from the ink flow path. The present exemplary embodiment thus realizes a preferable technique in which the openings of the ink supply port and the liquid passage can be formed small.

Referring to FIG. 6, the inkjet substrate 1 and the supporting member 2 are bonded by the adhesive 4 as described above. The inkjet substrate 1 includes the concave portion on the opposite side of the surface on which the flow path forming member 3 is disposed. The inkjet substrate 1 is bonded to the supporting member 2 at the bottom of the concave portion.

All of the ink supply ports 8, the plurality of supply passages 11, and the plurality of discharge passages 13 are formed through the inkjet substrate in the bottom of the concave portion. The ink supply ports 8, the plurality of supply passages 11, and the plurality of discharge passages 13 are formed of through-holes having a side wall that is perpendicular with respect to a surface direction of the inkjet substrate 1.

The supporting member 2 includes the ink introduction port (introduction port) 9 for supplying the ink to the ink supply port 8. Further, the supporting member 2 includes a supply path (i.e., the first liquid path) 12 for supplying the temperature control liquid to the supply passage 11, and a discharge path (i.e., the second liquid path) 14 for discharging the temperature control liquid from the discharge passage 13. The temperature control liquid can be transmitted from the discharge path 14 to the supply path 12 using the liquid circulation mechanism.

The supporting member 2 is bonded to the inkjet substrate 1 at the bottom of the concave portion so that the ink supply port 8 and the ink introduction port 9, the supply passage 11 and the supply path 12, and the discharge passage 13 and the discharge path 14 communicate with each other. The inkjet recording head can include an ink supplying member (not illustrated) that stores the ink for supplying the ink to the ink introduction port 9 of the supporting member 2.

Further, as described above, according to the present exemplary embodiment, one ink supply port 8 is formed for one nozzle array. A plurality of openings of the ink supply ports 8 is formed in a rectangular shape along the nozzle array in the bottom of the concave portion.

Furthermore, the supporting member 2 includes the convex shape that fits into the concave portion, and the ink introduction port 9, the supply path 12, and the discharge path 14 are opened on the upper surface of the convex portion. Each ink introduction port 9 is disposed to communicate with each ink supply port 8 when bonded, and the plurality of arrays is formed.

Further, it is preferable for the supporting member to have a convex portion that matches the concave portion of the head substrate. Such a supporting member can be created using a molding method.

As described above, according to the present exemplary embodiment, the inkjet substrate includes the concave portion formed on the opposite side (back side) of the surface on which the flow path forming member is disposed. The method for forming the concave portion is as described according to the first exemplary embodiment.

According to the present exemplary embodiment, the flow path forming member includes a plurality of nozzle arrays formed of the ink discharge port and the first liquid flow path that spatially communicate with each other. At least one supply port is formed for each nozzle array, and all of the supply ports are formed in the bottom of the concave portion. Further, referring to FIGS. 6, 7, and 8, one supply port having a rectangular opening is formed along one nozzle array. However, this is not a limitation, and a plurality of supply ports may be formed for one nozzle array.

If a plurality of supply ports is formed for one nozzle array, the introduction port may be disposed for each supply port communicating with the same nozzle array in the supporting member. Further, one introduction port may be formed for the plurality of supply ports communicating with the nozzle array.

Furthermore, it is preferable for the ink supply port 8, the supply passage 11, and the discharge passage 13 to be formed using dry etching. If dry etching is used, the side surface can be formed to be perpendicular with respect to a surface direction of the inkjet substrate, and the opening size can be made smaller. Moreover, the ink supply port 8, the supply passage 11, and the discharge passage 13 may be formed using laser other than using the dry etching.

According to a third exemplary embodiment of the present invention, an example in which the temperature control flow path (i.e., the second flow path) according to the second exemplary embodiment is a cooling flow path will be described with reference to FIG. 6.

Referring to FIG. 6, the inkjet substrate 1 is formed using a silicon substrate of thickness 0.3 mm to 1.0 mm. A plurality of discharge energy generation elements 7, such as heaters, is formed on the front side of the inkjet substrate 1. Further, the flow path forming member 3 formed on the inkjet substrate 1 configures the ink flow path 5 and the discharge port 6.

Furthermore, the flow path forming member 3 forms a cooling flow path 10 in which a cooling medium flows. The silicon substrate forming the inkjet substrate 1 has a crystal orientation of a <100> plane. The discharge energy generation element 7 is disposed below the ink discharge port 6.

The ink flow path 5 and the ink discharge port 6 are disposed in rows and form a plurality of nozzle arrays. The cooling flow path 10 is disposed around the nozzle arrays and between the nozzle arrays. A concave portion is formed on the back side of the inkjet substrate 1 using crystal anisotropic etching, and the exposed <100> plane becomes the bonding surface between the inkjet substrate 1 and the supporting member.

The ink supply port 8 passing through the inkjet substrate 1 from the bonding surface to the front side of the inkjet substrate 1 is formed for each nozzle array. The supply passage 11 for supplying the cooling medium to the cooling flow path 10 and the discharge passage 13 for discharging the cooling medium from the cooling flow path 10 are formed through the inkjet substrate 1 from the bonding surface to the front side of the inkjet substrate 1, to communicate with a portion of the cooling flow path.

The supporting member 2 includes the ink introduction port 9 for supplying the ink to the ink supply port 8. Further, the supporting member 2 and the inkjet substrate 1 are bonded using the adhesive 4 so that the ink introduction port 9 corresponds to the ink supply port 8. Furthermore, the supporting member 2 includes the supply path 12 for supplying the cooling medium to the supply passage 11, and the discharge path 14 for discharging the cooling medium from the discharge passage 13.

A liquid whose heat capacity is large and is stable in terms of heat can be selected as the cooling medium, such as water. Further, the ink which is discharged from the ink discharge port 6 and is recorded on the recording medium may be used as the cooling medium.

The liquid medium can be transferred by applying pressure from the liquid inlet to be pushed out from the liquid outlet. Further, the cooling port can be transferred by being suctioned out from the liquid outlet. Various pumps capable of transferring the liquid can be used as a driving source. The pump is set on the main body of the inkjet printer, and can be connected to a cooling medium opening 13 of the inkjet head 1.

As described above, the inkjet head in which the cooling medium can be circulated is achieved, so that discharging of heat generated due to bubbling can be greatly improved. As a result, temperature rise of the head during recording can be reduced, even when energy input to the head per unit time increases. Problems such as variation in the ink discharge amount for each page or instability of discharging at high temperature can thus be reduced, and continuous recording ability and recording reliability can be improved.

Further, as illustrated in FIG. 7, it is preferable to dispose the cooling flow path 10 so that the shortest distance (refer to d in FIG. 7) between the cooling flow path disposed to surround the nozzle array, and the heater 7 from which the heat is generated in the surface direction (horizontal direction), becomes approximately constant for each heater.

Referring to FIG. 7, the heater 7 is disposed directly below the discharge port 6. If the distance d is constant, the heat is uniformly discharged, so that heat dissipation for each nozzle can be caused to become consistent.

According to the present invention, a heat diffusion layer can be disposed on the head substrate to expand from a bubbling portion above the discharge energy generation element to the second liquid flow path. More specifically, the heat diffusion layer formed of metal is formed above the discharge energy generation element and expanded to the second liquid flow path.

With such a configuration, the heat generated in the discharge energy generation element can be efficiently transmitted to the second liquid flow path. Further, the heat diffusion layer can also act as a cavitation-resistant film.

Figure 9:
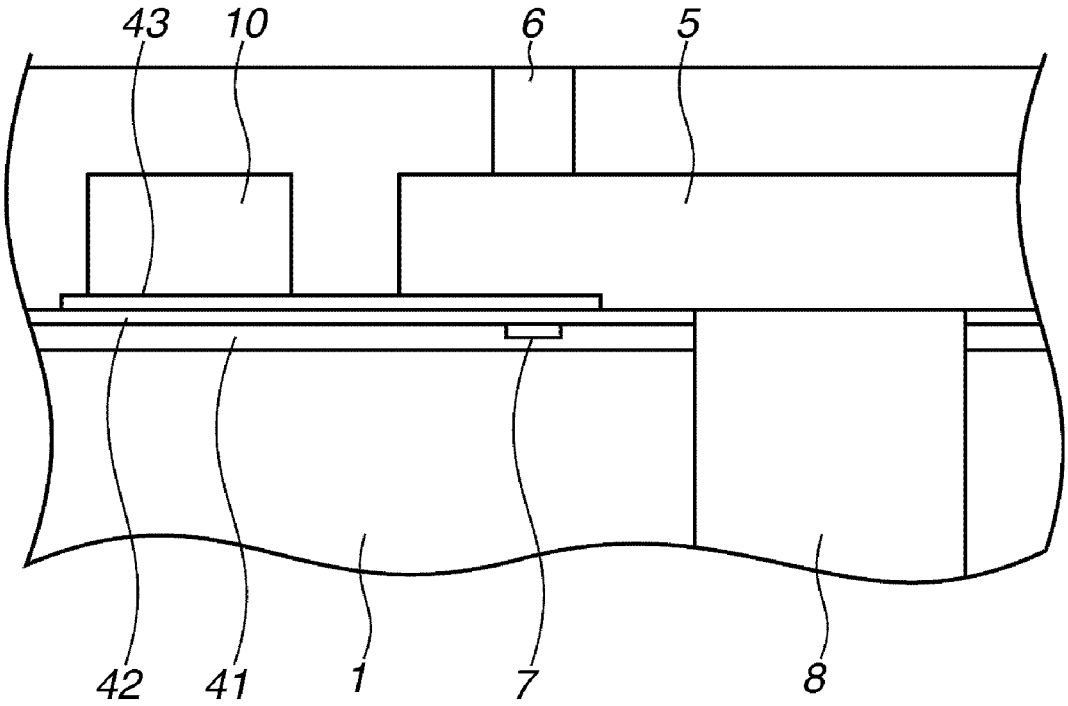
FIG. 9 is an enlarged cross-sectional view illustrating a portion surrounded with a dotted line frame X illustrated in FIG. 6 according to an exemplary embodiment of the present invention.

A fourth exemplary embodiment will be described in detail below. FIG. 9 is an enlarged cross-sectional view illustrating a portion surrounded by a dotted line frame X illustrated in FIG. 6.

Referring to FIG. 9, an insulating film 41 and a passivation film 42 are formed on the front side of the silicon substrate of the inkjet substrate 1. The heater 7, i.e., the discharge energy generation element, is included in the insulating film 41 and the passivation film 42. The insulating film 41 and the passivation film 42 are formed of films that satisfy the respective functions, such as a silicon oxide film or a silicon nitride film.

In the ink discharge method using heat bubbling, cavitation is generated when the bubble disappears, which may destroy the heater 7 and cause disconnection. To reduce the destruction due to cavitation, a cavitation-resistant film is generally disposed on the passivation film 42. According to the present invention, it is preferable to form a cavitation-resistant film 43 on the passivation film 42.

Metal is used to form the cavitation-resistant film in view of strength and flexibility. Further, tantalum (Ta) is used among the metals to form the cavitation-resistant film.

Since the cavitation-resistant film 43 is formed using metal, heat conductivity is extremely high as compared to the surrounding films (i.e., the insulating film 41 and the passivation film 42). As illustrated in FIG. 9, it thus becomes possible to actively diffuse the heat generated from the heater 7 to the cooling flow path 10 by disposing the cavitation-resistant film 43, expanded from above the heater 7 to a region adjacent to the cooling flow path 10.

As a result, cooling efficiency is further improved, and deterioration in print quality due to continuous discharge can be reduced. It is preferable for the cavitation-resistant film to be expanded from the bubbling portion above the heater 7 to the cooling flow path 10 and form the bottom surface of the cooling flow path 10.

FIG. 7 is a plan view illustrating a fifth exemplary embodiment of the present invention, and the layout of the cooling flow path 10 and the positions of the supply passage 11 and the discharge passage 13 may be determined to satisfy the functions thereof. For example, the cooling flow path 10, the supply passage 11, and the discharge passage 13 can be disposed as illustrated in FIGS. 10A and 10B.

Figure 10A:
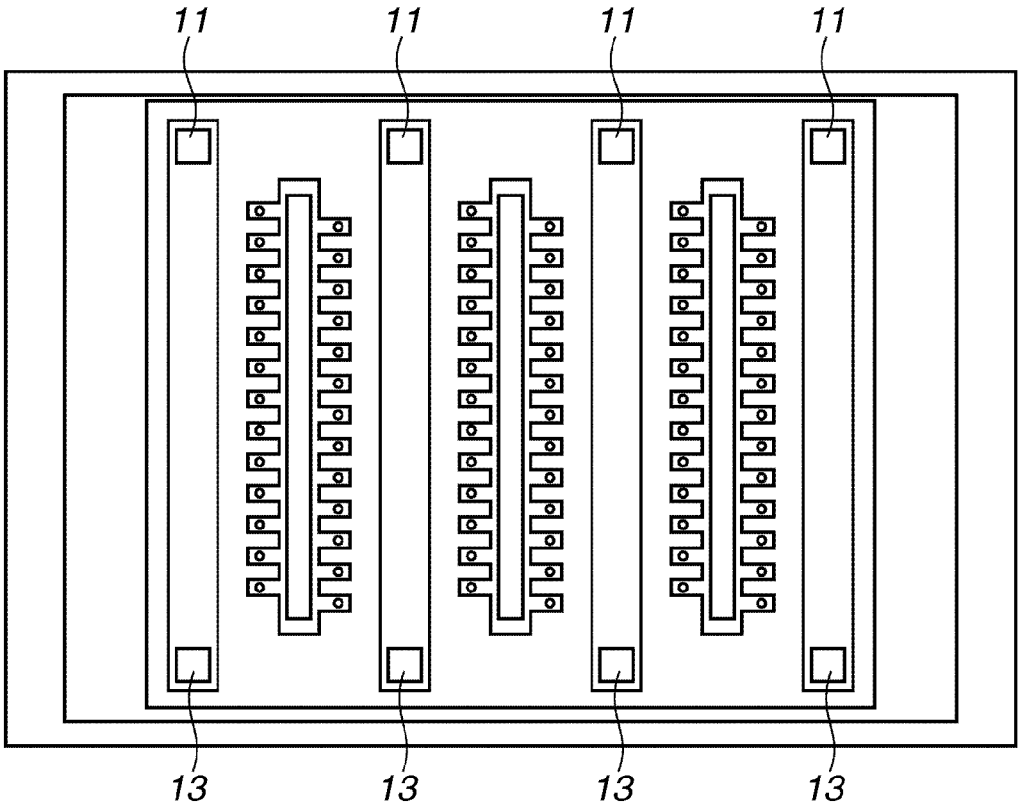
FIG. 10 is a schematic plan view illustrating a layout example of each of elements in the inkjet recording head according to an exemplary embodiment of the present invention.

Referring to FIG. 10A, the plurality of cooling flow paths 10 is disposed along both sides of the nozzle arrays. The supply passage 11 and the discharge passage 13 are disposed at the end portions of each cooling flow path 10. With this configuration, flow resistance can be reduced, and the cooling medium can be easily transmitted.

Figure 10B:
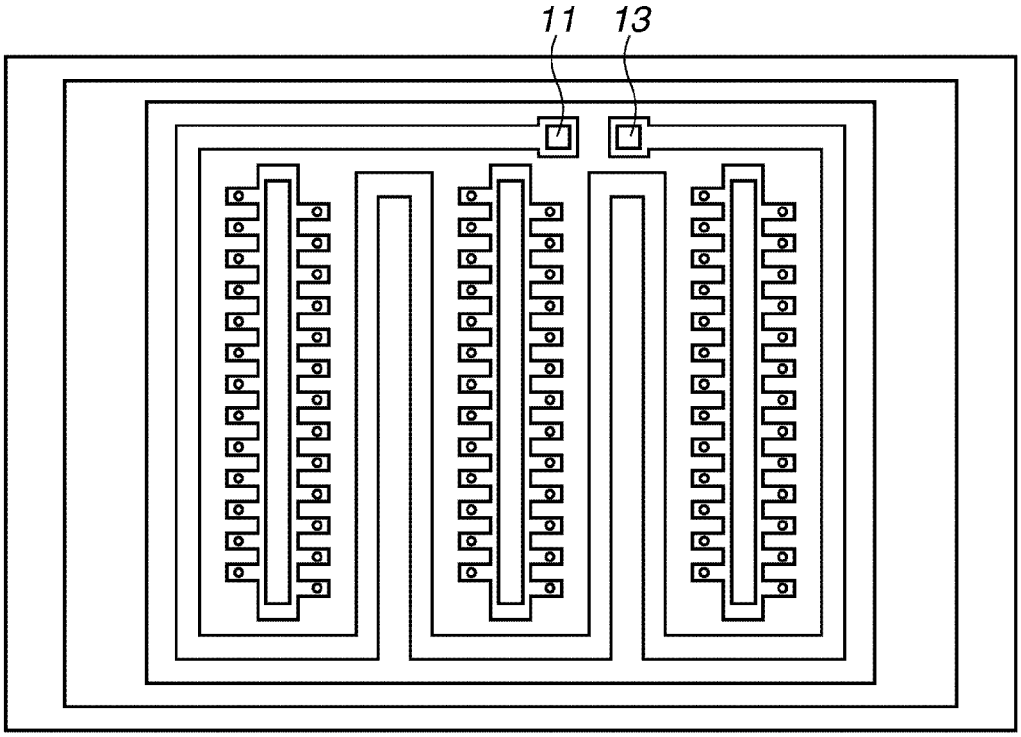

Referring to FIG. 10B, one cooling flow path 10 is formed, and the supply passage 11 and the discharge passage 13 are disposed close to each other. The cooling flow path 10 is extend from the liquid inlet near the supply passage 11 along both sides of each nozzle array, and reaches the liquid outlet near the discharge passage 13, and is disposed to approximately surround each nozzle array. Two or more cooling flow paths can be formed between the nozzle arrays as illustrated in FIG. 10B.

Figure 11A:
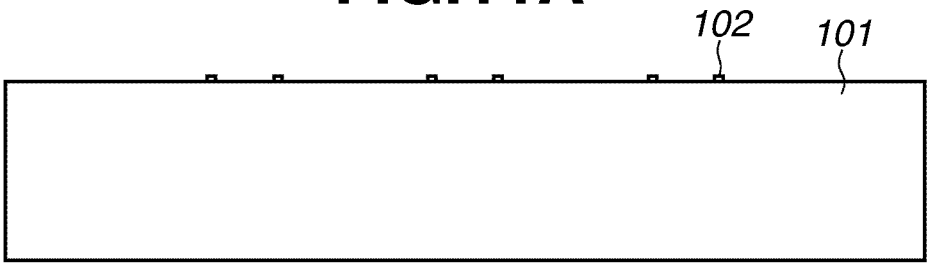
FIGS. 11A, 11B, 11C, 11D, 11E, 11F, and 11G are cross-sectional process charts illustrating a method for manufacturing the inkjet recording head according to an exemplary embodiment of the present invention.

FIGS. 11A, 11B, 11C, 11D, 11E, 11F, and 11G are process cross-sectional views illustrating a manufacturing method of the inkjet recording head according to a sixth exemplary embodiment of the present invention. Referring to FIG. 11A, an inkjet substrate 101 is provided. A heater 102 and a drive circuit (not illustrated) connected to the heater 102 are formed on the inkjet substrate 101.

Figure 11B:
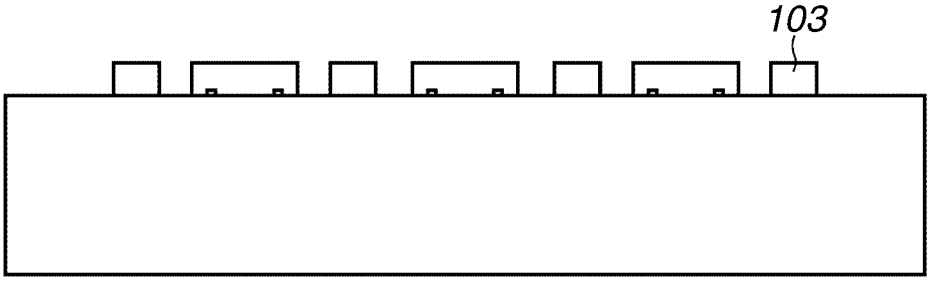

Referring to FIG. 11B, a flow path mold material 103 of the ink flow path and the cooling flow path 10 are formed. Since it is necessary for the flow path mold material 103 to be removable in a post process, the flow path mold material 103 can be formed using aluminum or resoluble resin. The mold material of the ink flow path is also referred to as a first mold material, and the mold material of the cooling flow path as a second mold material.

Figure 11C:
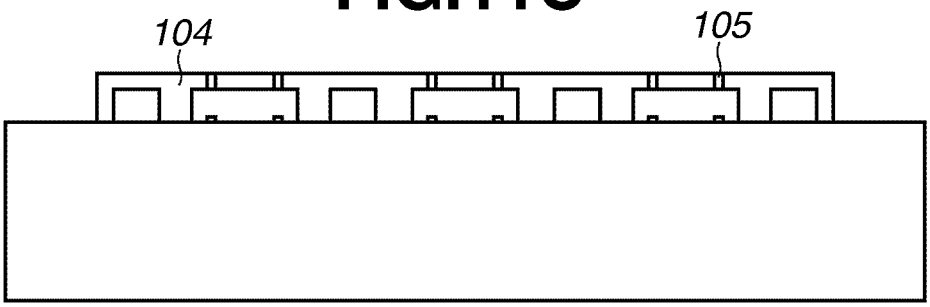

Referring to FIG. 11C, an organic resin is spin-coated and baked to coat the flow path mold material 103, and forms a flow path forming member 104. An ink discharge port 105 is then formed.

If the organic resin forming the flow path forming member 104 is photosensitive, the ink discharge port 105 can be formed by exposing and developing. Further, if the organic resin is not photosensitive, the ink discharge port 105 can be formed by laser processing or photolithography and etching.

If the flow path forming member 104 is to be formed on the flow path mold material 103, the thickness of the flow path forming member may become thin at the end portion of the nozzle array and thus obstruct uniform bubbling inside the nozzle array. To solve such a problem, Japanese Patent Application Laid-Open No. 10-157150 discusses further setting a pattern as a base, exterior to the nozzle array, to improve flatness of the flow path forming member. According to the present exemplary embodiment, the flow path mold material formed in the position where the cooling flow path is to be formed may also act as such a base.

Figure 11D:
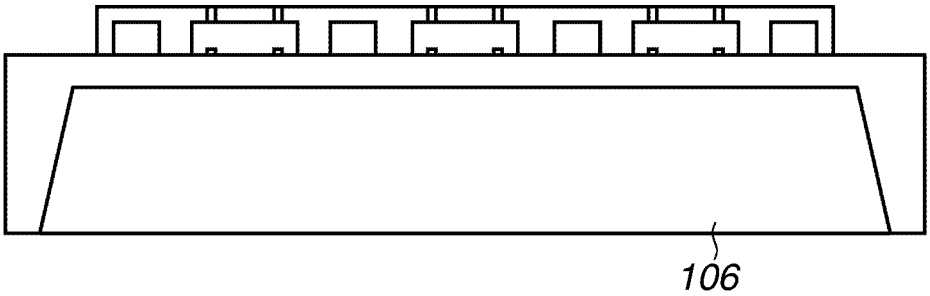

Referring to FIG. 11D, a concave portion 106 is formed on the back side of the inkjet substrate 101, and becomes the bonding surface with the supporting member. The concave portion can be formed using crystal anisotropic etching employing alkali solution. If crystal anisotropic etching is to be employed, a protective film (not illustrated) may be formed to protect the flow path forming member 104.

Figure 11E:
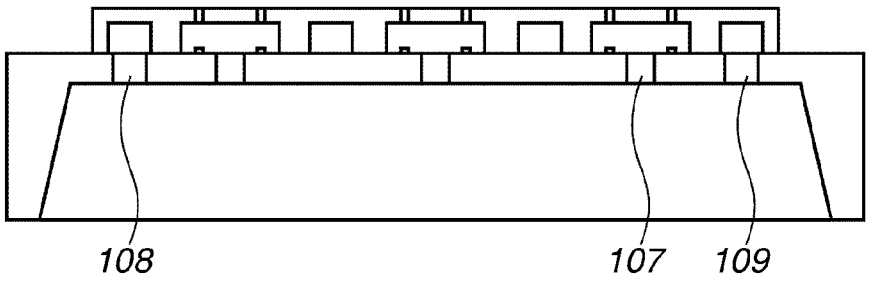

Referring to FIG. 11E, an ink supply port 107, a supply passage 108, and a discharge passage 109 are formed through the inkjet substrate 101. The through-holes can be formed employing dry etching using a photo-resist mask having a predetermined opening pattern. The bosch process, which is an example of deep silicon etching technique, is preferable as the dry etching method.

Figure 11F:
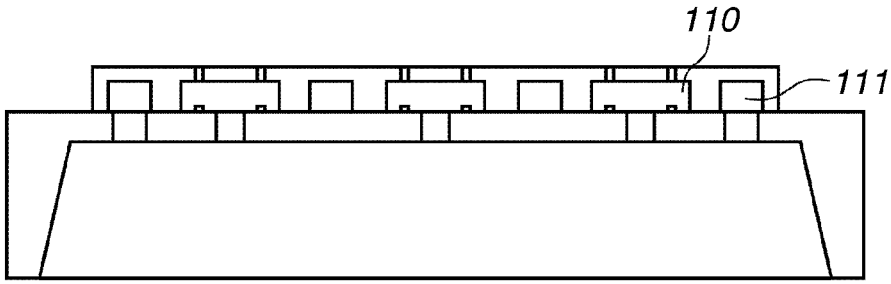

Referring to FIG. 11F, the flow path mold material 103 is dissolved and removed from the ink supply port 107, the supply passage 108, the discharge passage 109, and the ink discharge port 105. An ink flow path 110 and a cooling flow path 111 are then formed. A remover of the flow path mold material 103 is selected by considering the material of the mold material and the flow path forming member. If the mold material is aluminum, acid or alkali solution can be used as the remover, and if the mold material is an organic resin, a solvent which can elute the organic resin can be used.

Figure 11G:
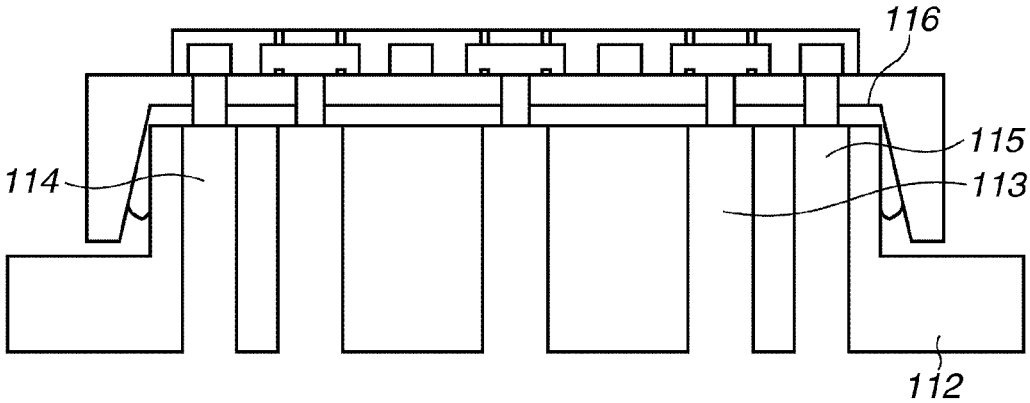
Figure 12:
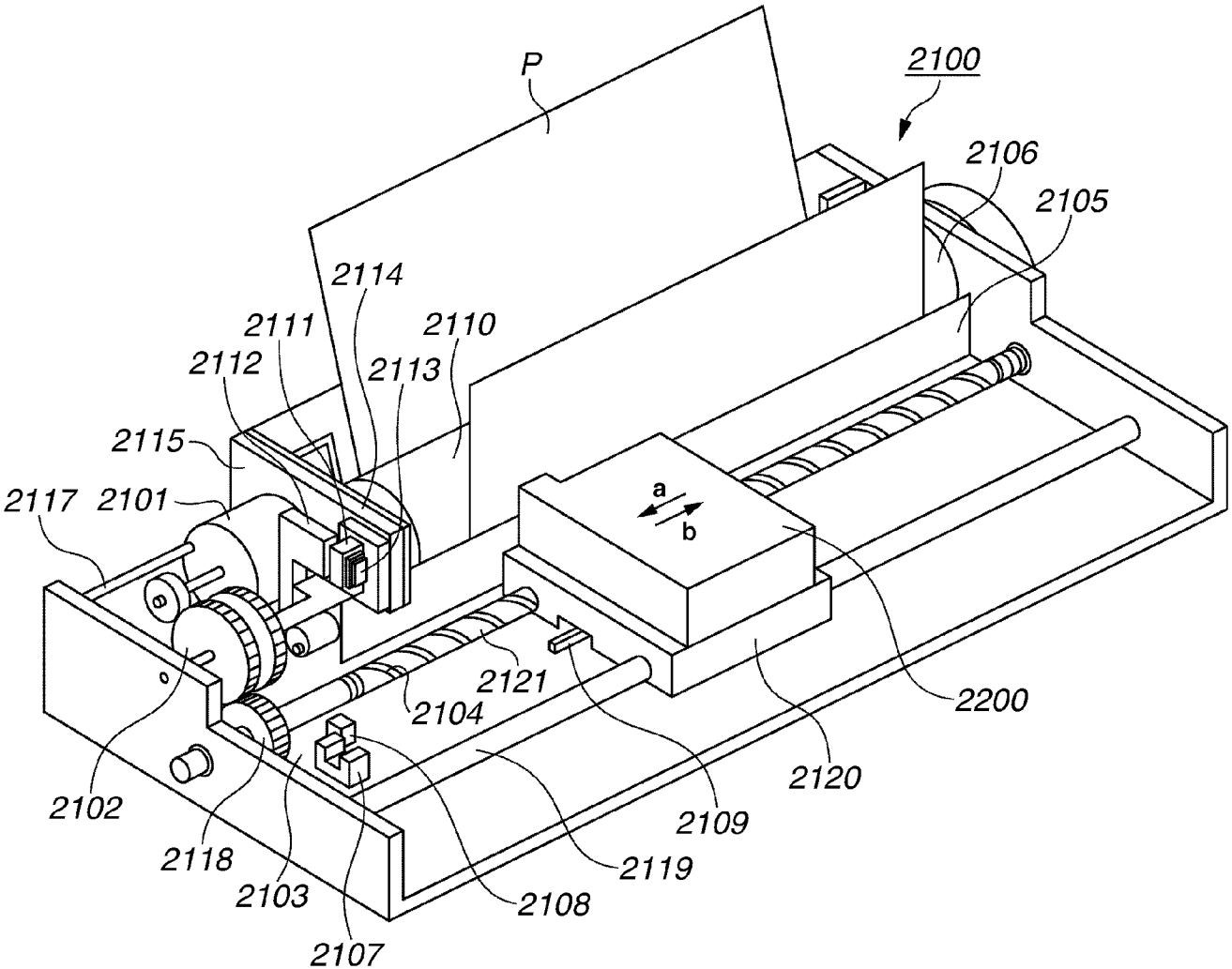
FIG. 12 is a schematic diagram illustrating a configuration example of an inkjet recording apparatus according to an exemplary embodiment of the present invention.

Referring to FIG. 11G, an adhesive 116 is used to bond the bottom of the concave portion 106 in the supporting member 112 with the inkjet substrate 101. The supporting member 112 includes an introduction port 113 for supplying the ink to the ink supply port 107, a supply path 114 for supplying the cooling medium to the supply passage 108, and a discharge path 115 for discharging the cooling medium from the discharge passage 109.

The supporting member 112 includes a convex portion, and the introduction port 113, the supply passage 114, and the discharge passage 115 open on the upper surface of the convex portion. The upper surface of the convex portion bonds with the bottom surface of the concave portion.

The manufacturing method of the inkjet recording head will be described in detail below with reference to FIGS. 4 and 5. The present invention is not limited to the exemplary embodiment to be described below.

Figure 4A:
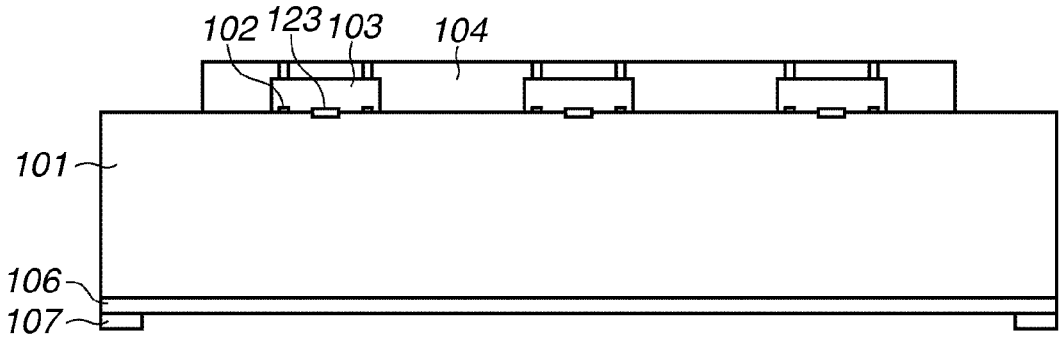
FIGS. 4A, 4B, 4C, 4D, 4E, 4F, 4G, and 4H are schematic process charts illustrating a method for forming a concave portion and an ink supply port of the inkjet substrate according to an exemplary embodiment of the present invention.

FIG. 4A illustrates the inkjet substrate 101 and a flow path forming member 105 formed using silicon. The heater 102, i.e., the discharge energy generation element, and an etching stop layer 123 are formed on the front side of the inkjet substrate 101.

Further, an insulating layer (not illustrated) is formed above the heater 102 and the etching stop layer 123. The etching stop layer 123 is formed by spattering aluminum of 500 nm thickness. The insulating layer is formed by performing plasma chemical vacuum deposition (CVD) on an oxide film of 700 nm thickness. The thickness of the inkjet substrate 101 is 700 μm. Further, a thermally-oxidized film 106 whose thickness is 600 nm is formed on the back side of the inkjet substrate.

A mold material 103 of the ink flow path is formed on the front side of the inkjet substrate. The mold material 103 is formed employing a positive photoresist. The flow path forming member 104 is formed above the mold material 103 and the inkjet substrate 101. An adhesive layer (not illustrated) formed by a polyether amide resin layer can also be formed to improve adhesion of the flow path forming member and the inkjet substrate.

Figure 4B:
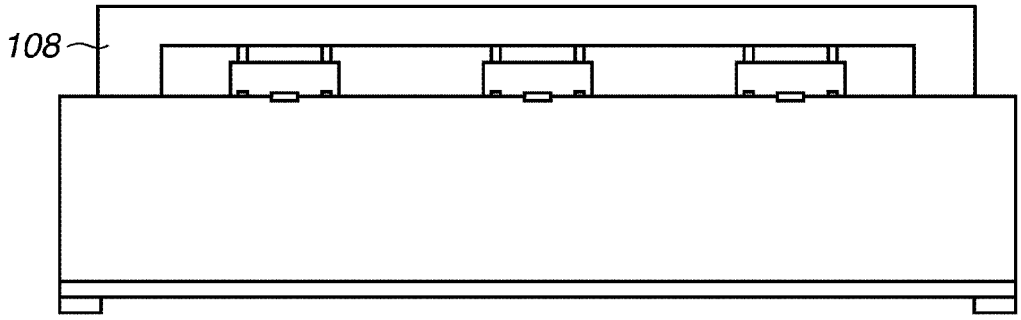

A back side mask 107 for forming the concave portion is formed on the back side of the inkjet substrate 101, using polyether amide resin. Referring to FIG. 4B, a protective resist 108 is formed to protect the front surface of the inkjet substrate 101 and the flow path forming member 105 from an alkali etching solution. "OBC" manufactured by Tokyo Ohka Kougyou Co., Ltd., is used as the protective resist.

Figure 4C:
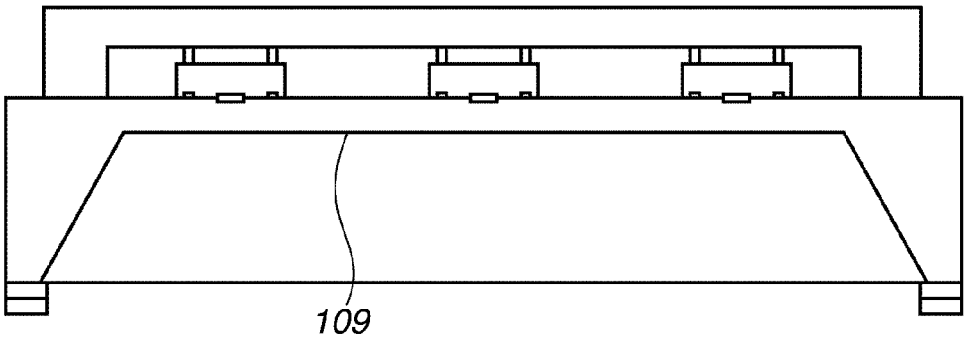

Referring to FIG. 4*c*, the crystal anisotropic etching is performed using the back side mask 107 by immersing the back side of the inkjet substrate in a tetramethyl ammonium hydroxide aqueous solution (22 wt %, 83° C.) for 12 hours. The concave portion including a bonding surface 109 is thus formed. The depth of the concave portion, i.e., the distance from the original back side position to the bonding surface 109, is 600 μm.

Figure 4D:
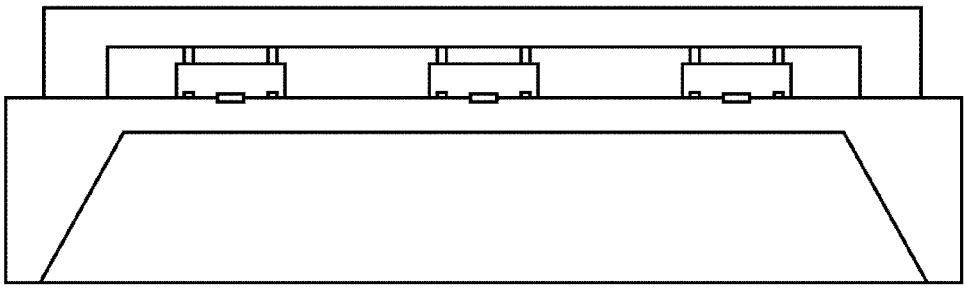

Referring to FIG. 4D, the back side mask 107 and a heat-oxidized film 106 are then removed.

Figure 4E:
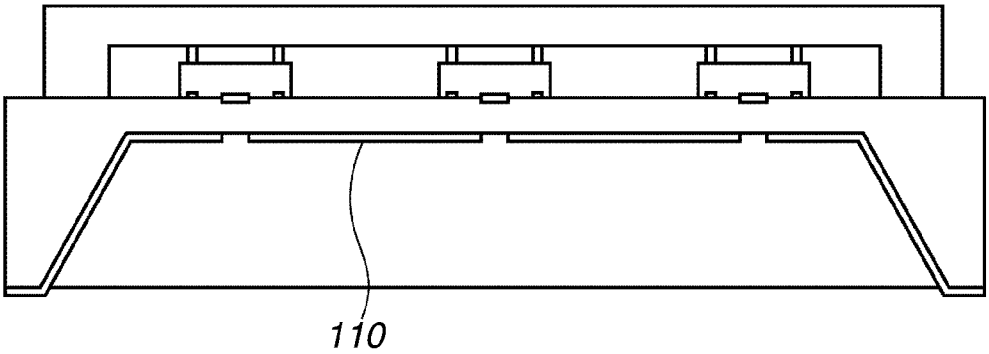

Referring to FIG. 4E, an ink supply port mask 110 is formed. A photosensitive material (AZP4620 "product name", manufactured by AZ Electronic Materials Co., Ltd) is used as the material of the ink supply port mask 110. Further, the material is uniformly coated using a spraying apparatus (EVG 150 "product name", manufactured by EVG Co., Ltd.), exposed and developed, and forms an opening pattern corresponding to the ink supply port.

Figure 4F:
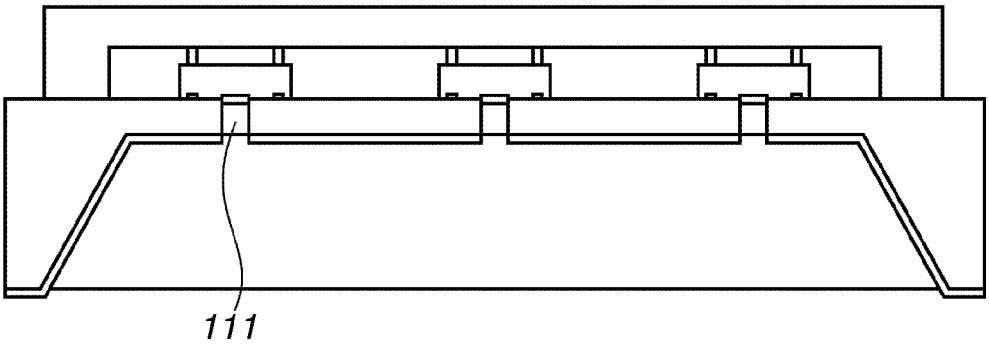

Referring to FIG. 4F, dry etching is performed using the ink supply port mask 110 and an ink supply port 111 is formed on the inkjet substrate 101. RIE is used as the dry etching method.

Figure 4G:
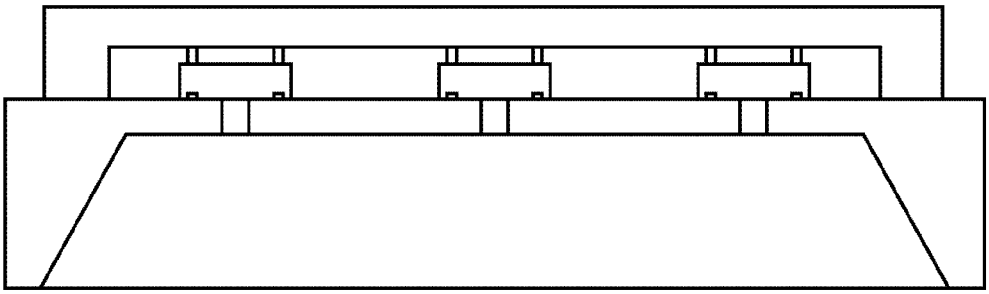

Referring to FIG. 4G, the ink supply port mask 110 formed on the back side of the inkjet substrate 101 is removed, and the etching stop layer 103 and the insulating layer are then removed.

Figure 4H:
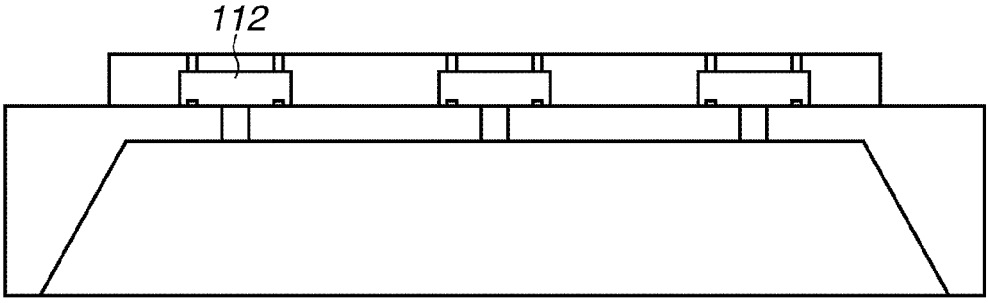

Referring to FIG. 4H, a protective resist 108 is removed. Further, the mold material 103 is removed, an ink flow path 112 is formed, and the discharge element substrate is manufactured.

The discharge element substrate and the supporting member acquired by the above-described manufacturing method are bonded at the bottom surface of the concave portion so that the ink supply port 111 and the ink introduction port communicate with each other. The inkjet recording head is thus acquired (refer to FIG. 1). Alumina is used in forming the supporting member.

Figure 5:
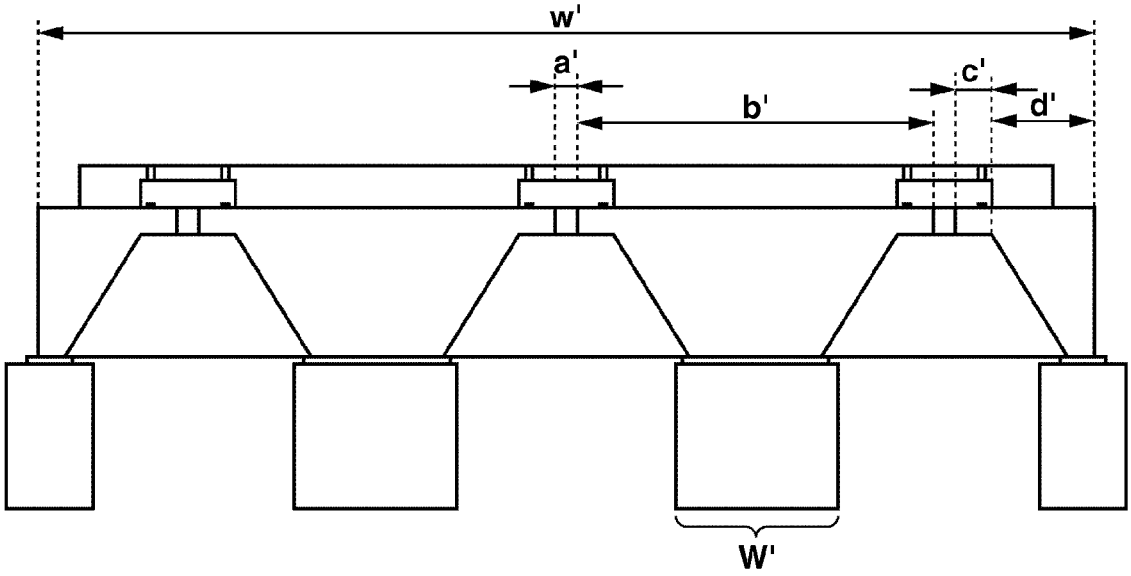
FIG. 5 is a schematic cross-sectional view illustrating a configuration example of a conventional inkjet recording head.

The processes illustrated in FIGS. 4 and 5 are performed while the inkjet substrate is in the form of a wafer. The inkjet substrate is then cut out in a dicing process, and becomes a single inkjet substrate as illustrated in the drawings. The adhesive is then coated around the ink introduction port in the supporting member, and the supporting member is bonded with the inkjet substrate 20.

Further, an electrical connection (not illustrated) is performed on the inkjet substrate and the inkjet recording head.

A print durability test has been performed using the inkjet recording head manufactured employing the above-described manufacturing method. A result is acquired in which the reliability of sealing between each of the colors is high, and high recording reliability is achieved even when high-speed printing is performed.

Further, dimensions of the inkjet recording head formed by the above-described manufacturing method will be described in detail with reference to FIGS. 1 and 4 to specifically illustrate the effect of the present invention.

The dimensions of the inkjet recording head according to the present exemplary embodiment will be described below with reference to FIG. 1. The opening size of the ink supply port is 100 μm. The distance b between the ink supply ports of the adjacent nozzle arrays is 1100 μm. The distance c in the horizontal direction from the ink supply port positioned at the edge, to the edge region of the concave portion on the back side is 300 μm.

A distance d from the edge portion of the concave portion on the back side to the edge portion of the inkjet substrate is 500 μm. A width w of the entire inkjet substrate thus becomes 4100 μm. The width W of the bonding section of 800 μm can then be acquired.

FIG. 5 is a cross-sectional view illustrating the conventional inkjet recording head. Referring to FIG. 5, the conventional inkjet recording substrate is bonded to the supporting member at the back side other than the concave portion (i.e., a lowest surface of the inkjet substrate in FIG. 5). As a result, if the width W' that is equivalent to the width W of the bonding section illustrated in FIG. 1 is to be acquired, the entire inkjet substrate becomes larger as illustrated in FIG. 5.

More specifically, the width of the bonding section "W'" is set as 800 μm, similarly as the dimension of the above-described exemplary embodiment. In such a case, the opening size of the ink supply port a' illustrated in FIG. 5 is 100 μm. A distance b' between the ink supply ports of the adjacent nozzle arrays becomes large due to the crystal orientation of the silicon substrate, i.e., becomes 1950 μm. Further, c' becomes 150 μm, and d' becomes 500 μm. The width of the entire inkjet substrate w' thus becomes 5500 μm, which is large.

As described above, according to the present invention, a sufficient ground contact area between the supporting member and the head substrate can be secured, and the size of the head substrate can be downsized.

According to the present invention, a liquid discharge head which is highly reliable and having high heat dissipation ability can be provided without reducing the productivity of the head substrate. As a result, the liquid discharge head according to the present invention can respond an increase in the print speed.

Further, according to another aspect of the present invention, a liquid discharge head having durability and which can be downsized can be provided. In other words, according to the present invention, the dimension of the supply port can be reduced while maintaining the strength of the head substrate, so that downsizing can be performed while maintaining durability. Further, since the discharge ports can be formed with high density, the discharge performance can also be improved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-115232 filed May 19, 2010 and No. 2010-115233 filed May 19, 2010 and No. 2011-099580 filed Apr. 27, 2011, which are hereby incorporated by reference herein in their entirety.

What is claimed is:

1. A liquid discharge head comprising:

a flow path forming member including a plurality of nozzle arrays each formed of a discharge port for discharging a liquid and a liquid flow path that spatially communicate with each other;

a head substrate including a discharge energy generation element that generates energy for discharging the liquid, and in which a supply port for supplying the liquid to the liquid flow path is formed for each of the nozzle arrays; and a supporting member including an introduction port for supplying the liquid to the supply port, wherein the head substrate includes a concave portion on an opposite side of a surface on which the flow path forming member is disposed, wherein the supply ports are formed from a bottom of the concave portion to the surface on which the flow path forming member is disposed, and wherein the head substrate and the supporting member are bonded interior to the concave portion are so that the supply port and the introduction port communicate with each other.

2. The liquid discharge head according to claim 1, wherein the supply port is formed along the nozzle array.

3. The liquid discharge head according to claim 1, wherein the concave portion is formed by anisotropic etching.

4. The liquid discharge head according to claim 1, wherein the concave portion is formed by crystal anisotropic etching.

5. The liquid discharge head according to claim 4, wherein the head substrate is formed using a silicon substrate having crystal orientation of a <100> plane.

6. The liquid discharge head according to claim 5, wherein the bottom of the concave portion is a <100> plane formed by the crystal anisotropic etching, and the <100> plane becomes a bonding surface of the head substrate and the supporting member.

7. The liquid discharge head according to claim 1, further comprising:

a second liquid flow path in which a second liquid flows; and wherein a supply passage for supplying the second liquid to the second liquid flow path, and a discharge passage for discharging the second liquid from the second liquid flow path, are formed on the head substrate, and wherein the flow path forming member and the head substrate are formed so that the second liquid flow path, the supply passage, and the discharge passage are formed to communicate with each other, and the liquid flow path and the supply port are formed to communicate with each other.

8. The liquid discharge head according to claim 7, wherein the second liquid flow path includes a liquid inlet through which the second liquid is supplied to the second liquid flow path and a liquid outlet through which the second liquid is discharged from the second liquid flow path, and wherein the liquid inlet is connected to the first liquid passage, and the liquid outlet is connected to the second liquid passage.

9. The liquid discharge head according to claim 7, wherein a heat diffusion layer formed of metal is formed on the discharge energy generation element so as to expand to the second liquid flow path.

* * * * *